US006367780B1

(12) United States Patent
Retterer

(10) Patent No.: US 6,367,780 B1
(45) Date of Patent: Apr. 9, 2002

(54) RE-INFORCED VINYL EXTRUSIONS

(75) Inventor: John M. Retterer, Caledonia, OH (US)

(73) Assignee: Claridon Tool & Die, Caledonia, OH (US)

( * ) Notice: Subject to any disclaimer, the term of this patent is extended or adjusted under 35 U.S.C. 154(b) by 0 days.

(21) Appl. No.: 09/671,852

(22) Filed: Sep. 27, 2000

(51) Int. Cl.[7] ..... E04H 17/00
(52) U.S. Cl. ..... 256/1; 256/19
(58) Field of Search ..... 256/1, 32, 59, 256/65, 19, 66

(56) References Cited

U.S. PATENT DOCUMENTS

| | | | | | |
|---|---|---|---|---|---|
| 3,554,494 | A | | 1/1971 | Bee | 256/19 |
| 3,733,055 | A | * | 5/1973 | Hughes, Jr. | 256/21 |
| 3,740,024 | A | * | 6/1973 | Hellerich et al. | 256/19 |
| 3,963,218 | A | * | 6/1976 | Glaesener | 256/1 |
| 4,075,473 | A | * | 2/1978 | Winston | 256/13.1 |
| 4,181,764 | A | | 1/1980 | Totten | 428/155 |
| 4,540,160 | A | | 9/1985 | Zanavich et al. | 256/19 |
| 4,684,107 | A | | 8/1987 | Robbins, Jr. | 256/19 |
| 4,953,830 | A | | 9/1990 | Weaver, III | 256/65 |
| 5,100,109 | A | | 3/1992 | Robbins, III | 256/59 |
| 5,458,942 | A | | 10/1995 | Miller | 428/6 |
| 5,788,224 | A | * | 8/1998 | Platt | 256/19 |
| 5,876,021 | A | * | 3/1999 | Spence et al. | 256/19 |
| 6,135,424 | A | * | 10/2000 | Bracke | 256/1 |

* cited by examiner

*Primary Examiner*—Harry C. Kim
(74) *Attorney, Agent, or Firm*—John L. Gray

(57) ABSTRACT

A hollow plastic member provided with end caps having holes therein through which wires can pass and be placed under tension so as to provide internal support for the member to reduce deflection of the member when a load is placed thereon and to return the member back within acceptable limits to its original position.

8 Claims, 3 Drawing Sheets

RE-INFORCED VINYL EXTRUSIONS

BACKGROUND OF THE INVENTION

Hollow plastic extrusions in the form of tubing or those extrusions which are rectangular in cross section are used for a variety of purposes, but especially for fence rails. Common plastic material used for this purpose is vinyl. When fence rails made from such materials are put under a load at right angles to the fence rail between the ends of the fence rail, the rail can deflect a great deal.

BRIEF SUMMARY OF THE INVENTION

The purpose of this invention is to prevent such deflection of hollow plastic extruded members, especially those used as fence rails. The hollow extruded member is provided with end caps which have at least two pairs of oppositely disposed holes therein and at least two wires each extending through each of two sets of holes in each end cap and extending the interior length of the fence rail and are then joined together at the outside of one of the end caps and placed under tension when so joined.

It is therefore an object of this invention to provide a hollow plastic extrusion with suitable interior wire reinforcing so as to prevent unnecessary deflection in use. This, together with other objects of the invention, will become apparent from the following detailed description of the invention and the accompanying drawings.

DETAILED DESCRIPTION OF THE INVENTION

Figure 1:
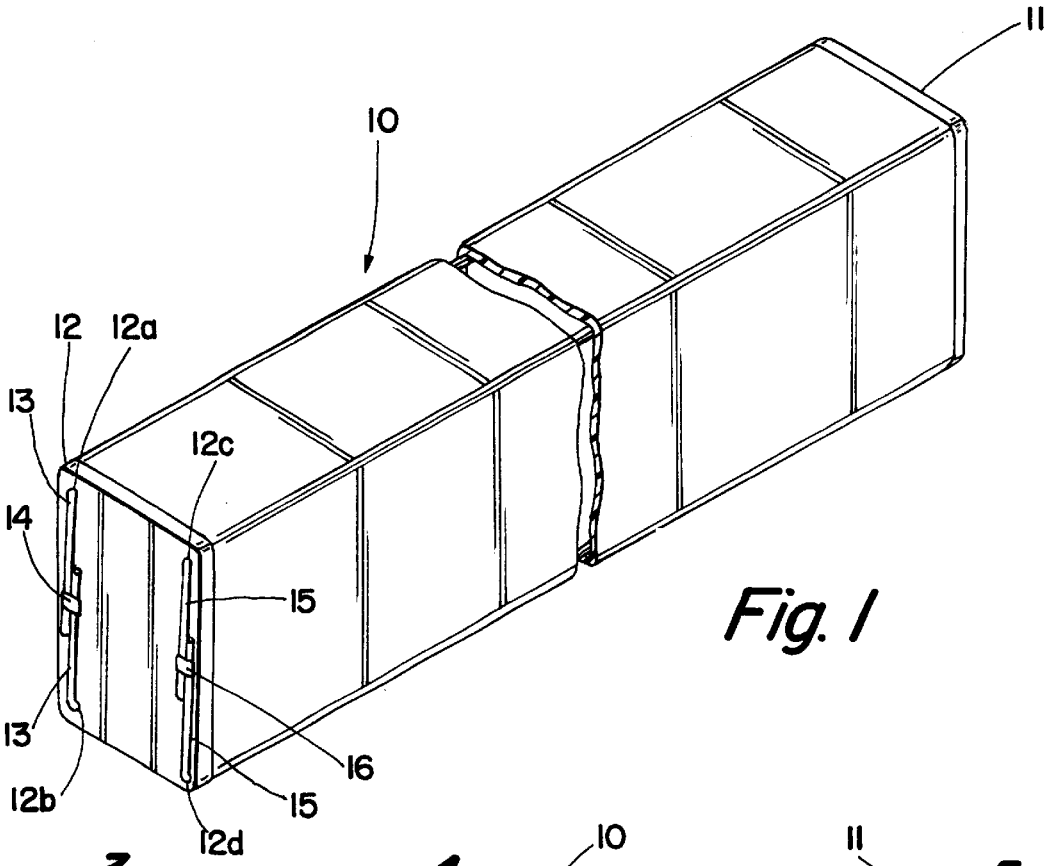
FIG. 1. A perspective view of an extruded plastic rectangular member with the two wires suitably connected together under tension.

Referring now to the drawings and in particular to FIG. 1, 10 is a typical fence rail provided with end caps 11 and 12. Each of the end caps has holes near the comers thereof through which the wires are shown extending. The holes in end cap 12 are shown at 12*a*, 12*b*, 12*c* and 12*d*. The holes in end cap 11 are shown at 11*a*, 11*b*, 11*c* and 11*d*. (See FIG. 5).

Figure 2:
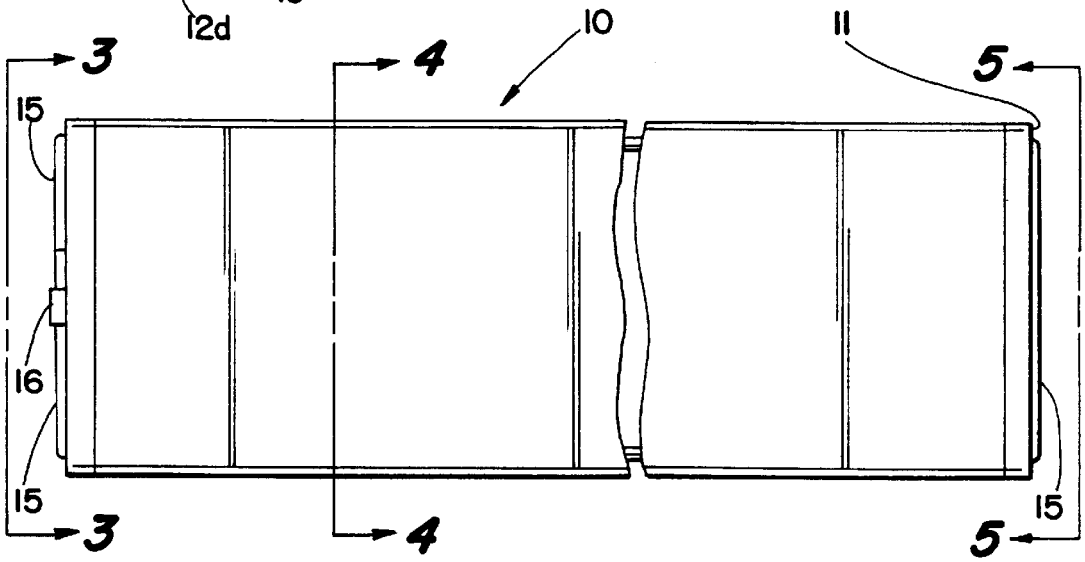
FIG. 2. A side elevation of the extruded plastic rectangular member.

One wire 13 extends through the two holes 11*a* and 11*b* in the end cap 11 (see FIG. 5), and through the corresponding two holes 12*a* and 12*b* in the end cap 12 and the two ends of wire 13 are joined together by connector 14 with the wire 13 under tension. Galvanized steel ⅛" high tension wire has been found to be very satisfactory. Similarly, wire 15 is led through the holes 12*c* and 12*d* in end cap 12 and the corresponding holes 11*c* and 11*d* in end cap 11 and the two ends of wire 15 are joined together by connector 16 with the wire 15 under tension. Also shown in FIG. 2 are the wire 15 and the connector 16.

Figure 5:
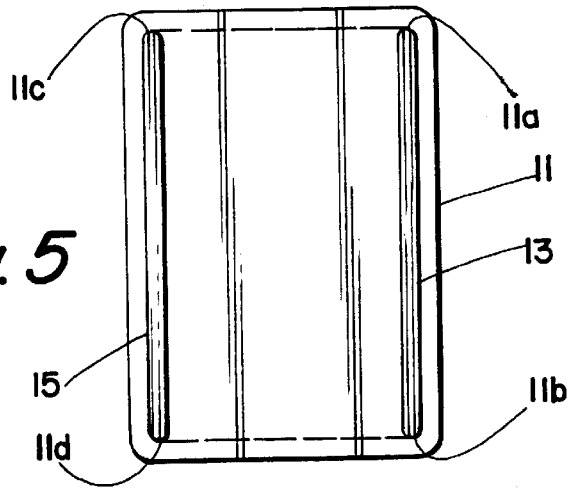
FIG. 5. An end view of the opposite end of the extruded plastic rectangular member.

Referring now to FIG. 5, it will be seen that the wire 15 extends through hole 11*c* in the end cap 11 down along the back of the end cap 11 and back through the hole 11*d* in the end cap 11.

Figure 3:
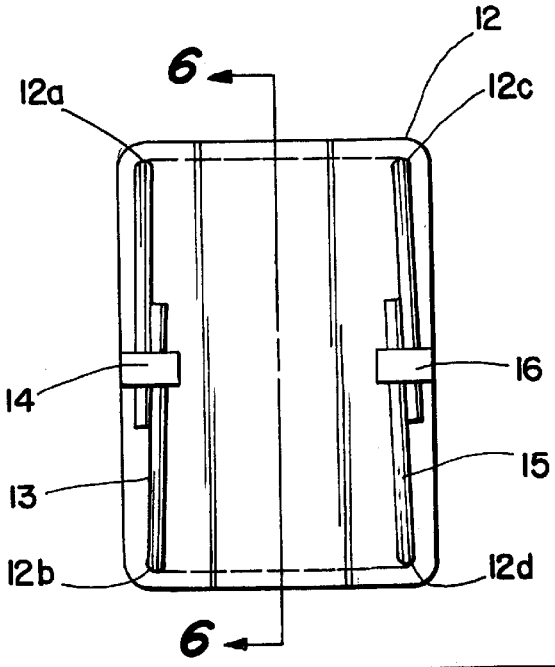
FIG. 3. An end view of the end of the extruded plastic rectangular member in FIG. 1 where the wires are joined together.

FIG. 3 shows the end cap 12 and the two ends of wire 13 and the two ends of wire 15 being joined together by connectors 14 and 16 respectively after having been placed under tension.

Figure 4:
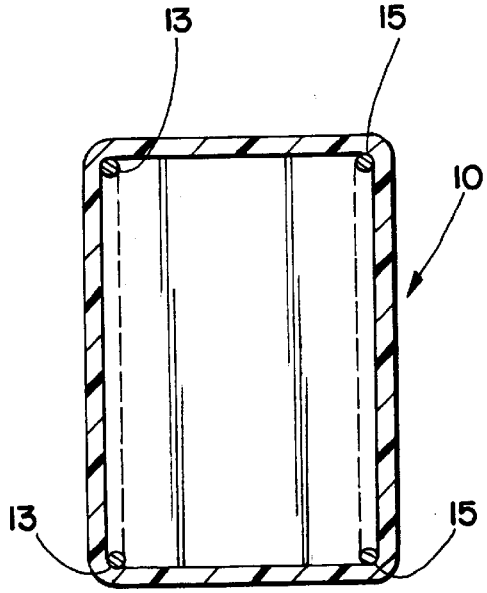
FIG. 4. A section through FIG. 2 on the plane 4—4.

In FIG. 4, the wires 13 and 15 are shown traversing the interior length of the fence rail 10 adjacent the four interior comers of the fence rail 10.

FIG. 5 is a view of the cap 11 and it will be seen that wire 13 enters through holes 11*a* and 11*b* in end cap 11 and the wire 15 enters the end cap 11 through holes 11*c* and 11*d* and then both wires return through the interior length of the fence rail 10 to the corresponding holes in end cap 12.

Figure 6:
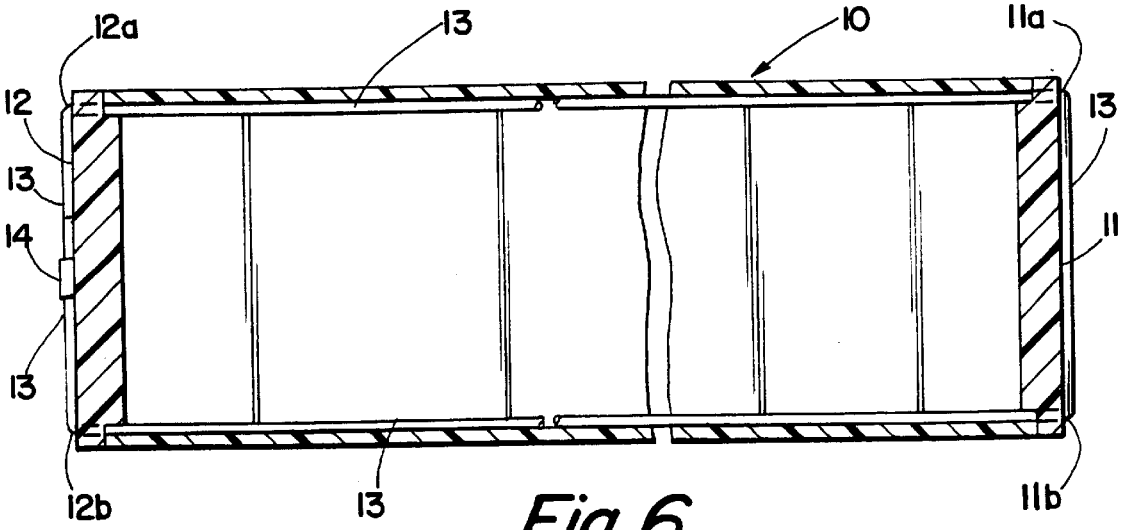
FIG. 6. A side view in section of the extruded plastic rectangular member shown in FIG. 1.

FIG. 6 is a section of the fence rail 10 showing the wire 13 entering holes 11 a and 11*b* in end cap 11, traversing the length of the interior of the fence rail 10 and exiting end cap 12 through holes 12*a* and 12*b* and being held together under tension by connector 14. Wire 15 is similarly positioned on the opposite side of fence rail 10.

Figure 7:
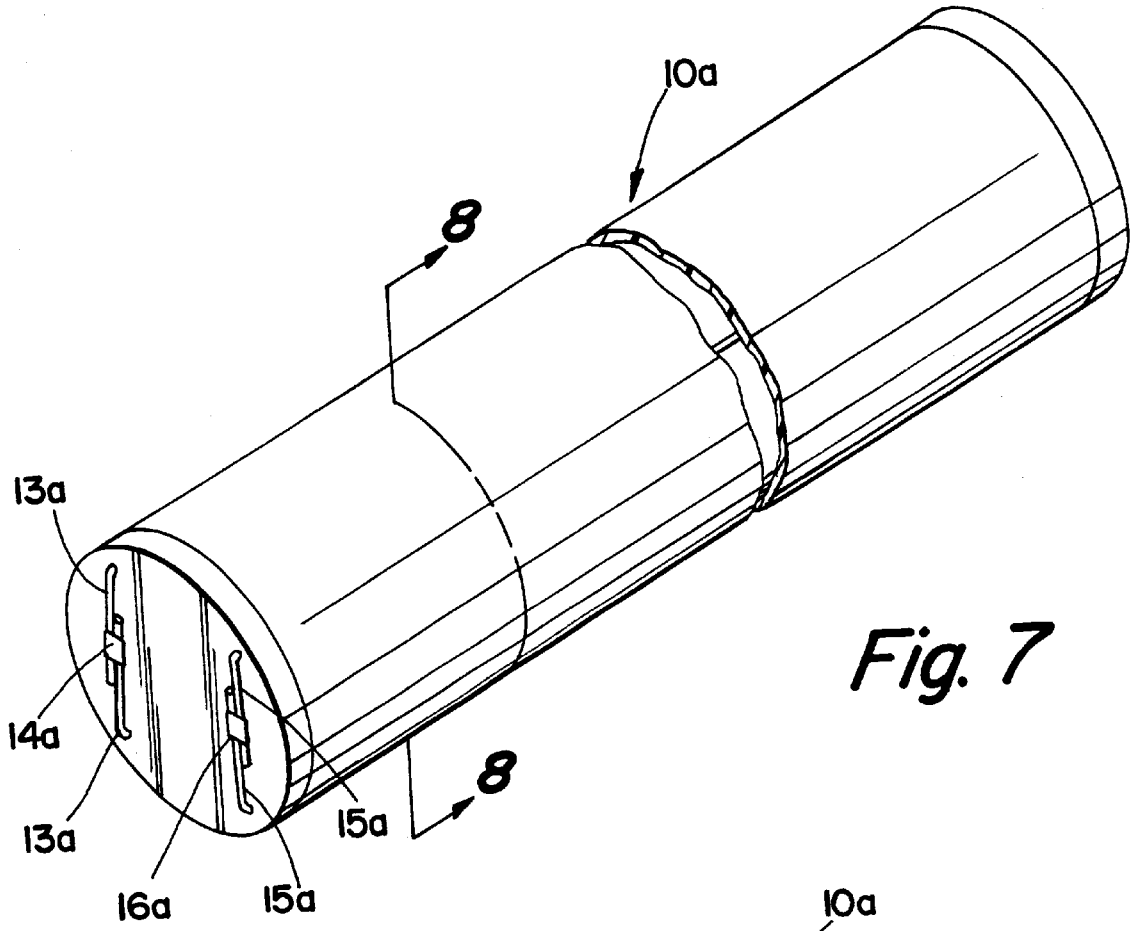
FIG. 7. An extruded plastic member similar to that shown in FIG. 1 only circular in cross section.
Figure 8:
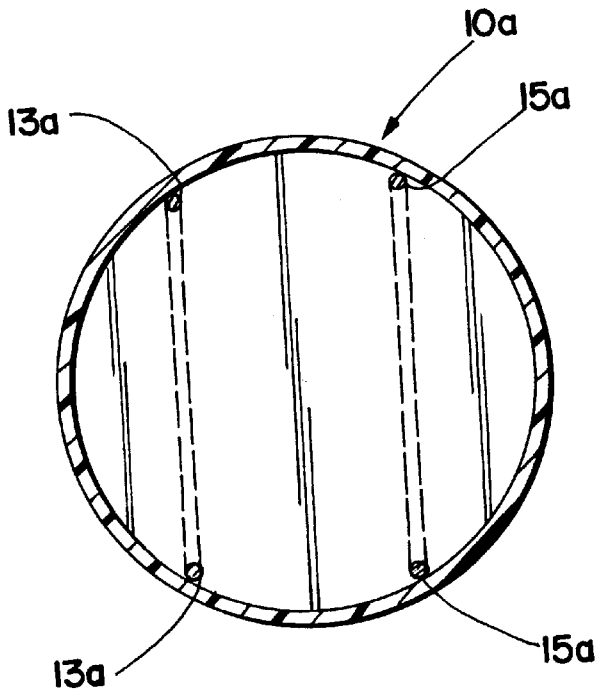
FIG. 8. A section through FIG. 7 on the plane 8—8.

FIG. 7 shows a variation of the fence rail 10, namely fence rail 10*a*, which is circular in cross section and also provided with end caps provided with corresponding holes and wires 13*a* and 15*a* and connectors 14*a* and 16*a* functioning in the same fashion as is the case with the fence rail 10 shown in FIG. 1. FIG. 8 is a sectional view of rail 10*a* on the plane of 8—8 as shown in FIG. 7 with the two wires 13*a* and 15*a* shown running the interior length of the rail 10*a*.

By constructing a hollow plastic member which is greater in length than in width with these internal wire supports under tension significant deflection of the member when a load is placed between the ends thereof is avoided and the member will return to within acceptable limits of its original position.

EXAMPLE

A standard 8 foot length of vinyl fence rail was supported at each end and a 500 lb. weight was placed on the fence rail at its center. The fence rail was distorted several feet and did not return to its original shape. An 8' long length of vinyl fence rail made in accordance with the present invention was supported at each end and a 500 pound weight was placed at the center thereof. The fence rail was only distorted 5" and when the weight was removed it recovered to within ½" of its original position.

While this invention has been shown and described with respect to a detailed embodiment thereof, it will be understood by those skilled in the art that various changes in form and detail thereof may be made without departing from the scope of the claims of the invention.

What is claimed is:

1. A hollow plastic member whose length is greater than its width having two ends, comprising an end cap covering each end of said member, each of said end caps being provided with two pairs of oppositely disposed openings therein adjacent to the edges of each of said end caps, each pair of said openings being positioned in a substantially vertical plane when said member is installed in use, two wires, each wire extending through each of said two pairs of openings in each end cap and extending the interior length of said member, each of said wires being joined at its ends outside of one said end caps and being placed under tension when so joined.

2. The hollow plastic member of claim 1 wherein said member is rectangular in cross section.

3. The hollow plastic member of claim 2 wherein the two pairs of oppositely disposed openings in said end caps are adjacent to the comers of each of said end caps.

4. The hollow plastic member of claim 1 wherein said member is circular in cross section.

5. The hollow plastic member of claim 1 wherein said rail is in the form of a fence rail.

6. The hollow plastic member of claim 4 wherein said rail is in the form of a fence rail.

7. The hollow plastic member of claim 5 wherein said rail is in the form of a vinyl fence rail.

8. The hollow plastic member of claim 6 wherein said rail is in the form of a vinyl fence rail.

* * * * *